US006361090B1

(12) United States Patent
Fan

(10) Patent No.: US 6,361,090 B1
(45) Date of Patent: Mar. 26, 2002

(54) LOCK APPARATUS

(76) Inventor: Fang-Yi Fan, No. 186, Min-Kuo Rd., Chia-Yi City (TW)

( * ) Notice: Subject to any disclaimer, the term of this patent is extended or adjusted under 35 U.S.C. 154(b) by 0 days.

(21) Appl. No.: 09/484,077

(22) Filed: Jan. 18, 2000

(51) Int. Cl.[7] ..... E05B 3/00
(52) U.S. Cl. ..... 292/336.3; 292/138; 292/140
(58) Field of Search ..... 292/336.3, 165, 292/140, 138, DIG. 61

(56) References Cited

U.S. PATENT DOCUMENTS

| | | | | | |
|---|---|---|---|---|---|
| 5,496,082 | A | * | 3/1996 | Zuckerman | 292/336.3 |
| 5,556,144 | A | * | 9/1996 | Lin | 292/336.3 |
| 5,617,749 | A | * | 4/1997 | Park | 70/224 |
| 5,727,406 | A | * | 3/1998 | Banducci | 70/224 |
| 5,732,578 | A | * | 3/1998 | Kang | 70/224 |
| 5,941,108 | A | * | 8/1999 | Shen | 292/336.3 X |

FOREIGN PATENT DOCUMENTS

| | | | | |
|---|---|---|---|---|
| GB | 272478 | * | 5/1994 | 292/336.3 |

* cited by examiner

*Primary Examiner*—Teri Pham Luu
(74) *Attorney, Agent, or Firm*—Ladas & Parry

(57) ABSTRACT

A lock apparatus includes a lock housing having a mounting wall and a surrounding wall which cooperatively confine a receiving space. A latch actuator is mounted on the lock housing, and includes an operable rotary disc and a spindle which extends rotatably into the receiving space via a spindle hole formed in the mounting wall. The rotary disc is operable to rotate the latch actuator between locking and unlocking positions. The spindle has a positioning section which has a peripheral portion formed with flat first and second positioning surfaces that are angularly displaced from each other. A latch member is mounted on the lock housing, and is associated operably with the latch actuator. An elongated spring plate is mounted in the receiving space, and is disposed perpendicular to the spindle. The spring plate abuts against the first positioning surface to retain the latch actuator in the locking position, and abuts against the second positioning surface to retain the latch actuator in the unlocking position.

7 Claims, 6 Drawing Sheets

LOCK APPARATUS

BACKGROUND OF THE INVENTION

1. Field of the Invention

The present invention relates to a lock apparatus, more particularly to a lock apparatus which has a relatively simple structure to simplify the manufacturing process and assembly thereof.

2. Description of the Related Art

FIGS. 1 and 2 illustrate a conventional lock apparatus 1 which is mounted on a door panel 2 to permit locking of the door panel 2 to an adjacent door frame 23. As shown, in the conventional lock apparatus 1, an elongated escutcheon 11 is mounted on an outer side 22 of the door panel 2. The escutcheon 11 is formed with upper and lower fastening posts 112, and a spindle hole 111 between the fastening posts 112. The door panel 2 is formed with a spindle hole 25 aligned with the spindle hole 111 in the escutcheon 11, and a pair of fastener holes 26 aligned with the fastening posts 112, respectively. A lock core unit 12 is mounted on the escutcheon 11 adjacent to the outer side 22 of the door panel 2. The lock core unit 12 has a cylindrical shell 121 extending into the spindle hole 111 and retained on the escutcheon 11 by means of a retaining ring 113, and a key operable lock core body 122 mounted on the shell 121 and operable by a key 123 that drives axial rotation of the lock core body 122 relative to the shell 121. The lock core body 122 has a drive end formed with a non-circular axial drive hole 124. A lock housing 13 is fastened to an inner side 21 of the door panel 2 by means of a pair of screw bolts 130. The screw bolts 130 extend respectively through a pair of fastening posts 137 in the lock housing 13, the fastener holes 26 in the door panel 2, and engage threadedly the fastening posts 112 of the escutcheon 11. The lock housing 13 has a mounting wall 131 parallel to the door panel 2, and a surrounding wall 134 that extends transversely from the mounting wall 131 toward the door panel 2 and that cooperates with the mounting wall 131 to confine a receiving space 135 in the housing 13. The surrounding wall 134 is formed with a notch 136 which is disposed adjacent to the door frame 23. The mounting wall 131 is formed with a circular mounting hole 132 which is axially aligned with the spindle holes 25, 111 in the door panel 2 and the escutcheon 11. The mounting wall 131 is further formed with a pair of diametrically opposite rivet projections 133 offset to the mounting hole 132. A latch actuator 14 is mounted on the lock housing 13 at the mounting hole 132. The latch actuator 14 includes a disc portion 141 retained at the mounting hole 132, an eccentric actuating rod 143 projecting from the disc portion 141, and an operable knob 142 formed on the disc portion 141 opposite to the actuating rod 143 and projecting from the lock housing 13 via the mounting hole 132 to permit manual operation of the latch actuator 14. A latch member 15 is disposed movably in the lock housing 13 adjacent to the notch 136. The latch member 15 is formed with an elongated slot 153 that permits extension of the actuating rod 143 therethrough, and is provided with a torsion spring 154 adjacent to the elongated slot 153. The torsion spring 154 has a biasing leg 155 that extends across the elongated slot 153 and that abuts against a circumferential surface of the actuating rod 143. When the operating knob 142 of the latch actuator 14 is operated to cause axial rotation of the disc portion 141 in the mounting hole 132, the latch member 15 can be moved by the actuating rod 143 to project from the lock housing 13 via the notch 136, or to retract into the receiving space 135 of the lock housing 13. The lock housing 13 is further mounted with a coupling member 16 and an L-shaped retaining plate 18. The coupling member 16 includes a circular disc 161, an axially extending sleeve 163 connected to the circular disc 161, and an axially extending flat spindle 17. The circular disc 161 has an eccentric coupling hole 162 that has the actuating rod 143 extending therethrough. The spindle 17 has a first end 172 extending into and engaging co-rotatably the sleeve 163, and a second end 171 extending through the spindle hole 25 in the door panel 2 and coupled to the drive hole 124 in the drive end of the lock core body 122 for co-rotation with the lock core body 122. The retaining plate 18 includes a first plate portion 181 parallel to the mounting wall 131 and formed with a circular opening 183 which is aligned with the mounting hole 132 in the mounting wall 131 and which permits the sleeve 163 and the spindle 17 of the coupling member 16 to extend therethrough. The first plate portion 181 has diagonally opposite corners formed with through holes 184 (only one is visible) that permit extension of the rivet projections 133 therethrough. The rivet projections 133 are punched after extending through the through holes 184 for securing the retaining plate 18 on the lock housing 13. The latch member 15 and the disc portion 161 of the coupling member 16 are retained between the mounting wall 131 and the first plate portion 181 of the retaining plate 18. The retaining plate 18 further has a second plate portion 182 perpendicular to the first plate portion 181 and disposed in the notch 136. In use, the lock apparatus 1 is operable from the inner side 21 of the door panel 2 by operating the knob 142 to move the latch actuator 14 to a locking position, where the latch member 15 projects from the lock housing 13 via the notch 136 and extends into a latch groove 24 formed in the door frame 23, thereby locking the door panel 2 to the door frame 23, and to an unlocking position, where the latch member 15 is retracted into the receiving space 135, thereby unlocking the door panel 2 from the door frame 23. The lock apparatus 1 can also be operated from the outer side 22 of the door panel 2 by operating the lock core unit 12 with the use of the key 123. Since the latch actuator 14 is coupled to the lock core body 122 by virtue of the coupling member 16, it can thus be driven by the key-operated lock core body 122 to move between the locking and unlocking positions. As the biasing leg 155 of the torsion spring 154 abuts against the circumferential surface of the actuating rod 143, the latch actuator 14 can be retained in the locking and unlocking positions.

However, in order to mount the torsion spring 154 on the latch member 15, the latch member 15 is formed with a spring hole 157 adjacent to the elongated slot 153 for retaining the torsion spring 154. The latch member 15 has one side opposite to the latch actuator 14 and formed with an abutment shoulder 158 adjacent to the elongated slot 153 to permit the biasing leg 155 of the torsion spring 154 to abut against the abutment shoulder 158 when the torsion spring 154 is disposed in the spring hole 157 during assembly, thereby positioning the biasing leg 155 so as to facilitate assembly of the latch actuator 14 to the latch member 15. In addition, the latch member 15 has another side facing the latch actuator 14 and formed with another abutment shoulder (not shown) for positioning an opposite leg (not shown) of the torsion spring 154. Therefore, the latch member 15 has a relatively complicated structure, and the assembly of the latch actuator 14 to the latch member 15 involves complicated and labor intensive tasks. Moreover, the retaining plate 18 is secured to the lock housing 13 by means of the rivet projections 133 via a rivet joint process, which further complicates the manufacture and assembly of the lock apparatus 1.

SUMMARY OF THE INVENTION

Therefore, the object of the present invention is to provide a lock apparatus having a relatively simple structure so as to simplify the manufacturing and assembly processes thereof.

Accordingly, the lock apparatus of the present invention includes a lock housing, a latch actuator, a latch member, and an elongated spring plate. The lock housing has a mounting wall and a surrounding wall that extends transversely from the mounting wall and that cooperates with the mounting wall to confine a receiving space. The mounting wall is formed with a circular spindle hole communicated with the receiving space. The latch actuator is mounted on the lock housing, and includes an operable rotary disc and a spindle which is connected to the rotary disc and which extends rotatably into the receiving space of the lock housing via the spindle hole. The rotary disc is operable to rotate the latch actuator about an axis of the spindle between a locking position and an unlocking position. The spindle has a positioning section which has a non-circular cross-section and which is disposed in the receiving space. The positioning section has a peripheral portion formed with a flat first positioning surface and a flat second positioning surface that is angularly displaced from the first positioning surface. The latch member is mounted movably on the lock housing, and is associated operably with the latch actuator such that the latch member projects relative to the lock housing when the latch actuator is moved to the locking position and such that the latch member is retracted into the lock housing when the latch actuator is moved to the unlocking position. The elongated spring plate is mounted in the receiving space of the lock housing, and extends in a direction perpendicular to the spindle. The spring plate abuts against the first positioning surface to retain the latch actuator in the locking position, and abuts against the second positioning surface to retain the latch actuator in the unlocking position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
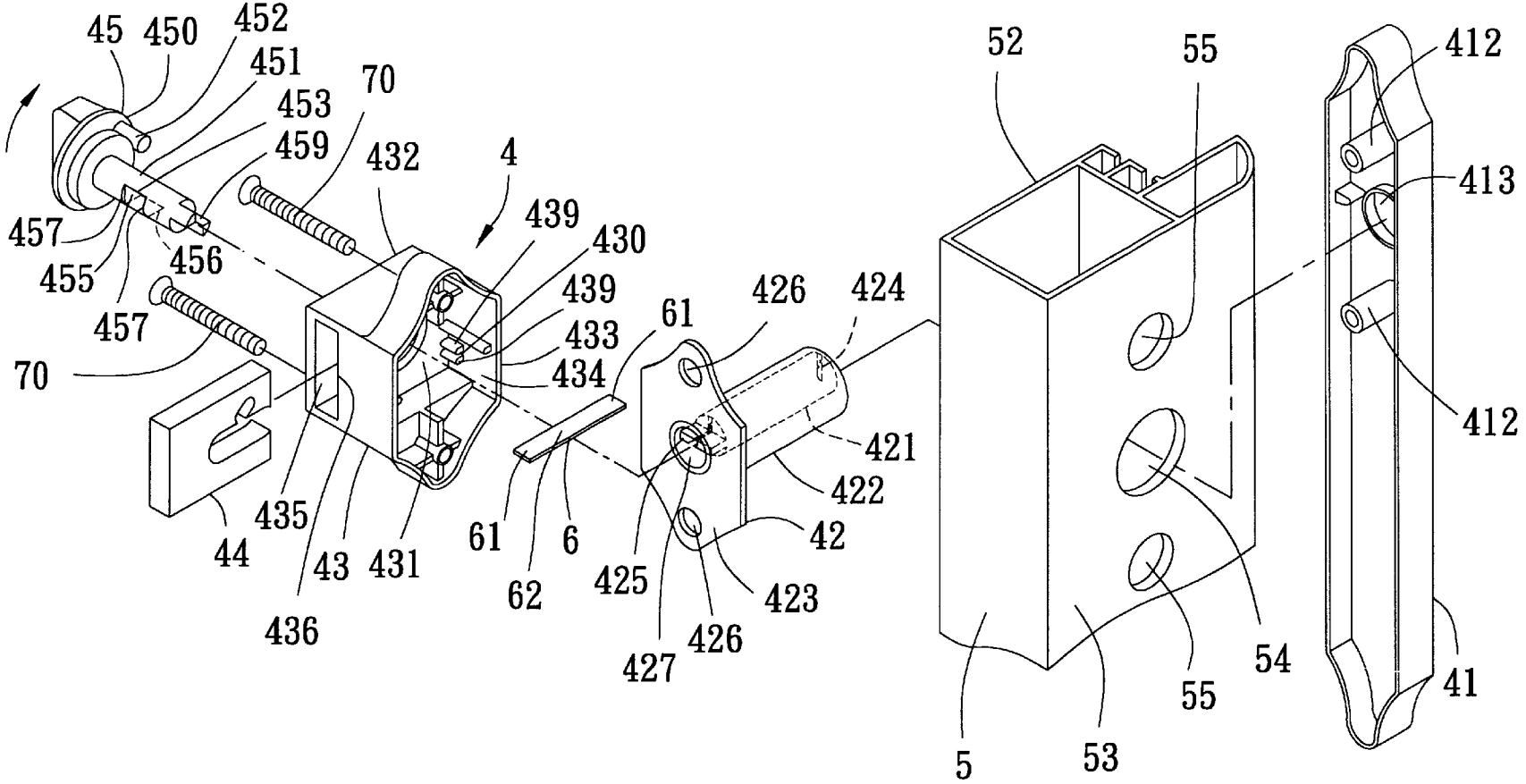
FIG. 3 is an exploded perspective view of a preferred embodiment of the lock apparatus of the present invention.
Figure 4:
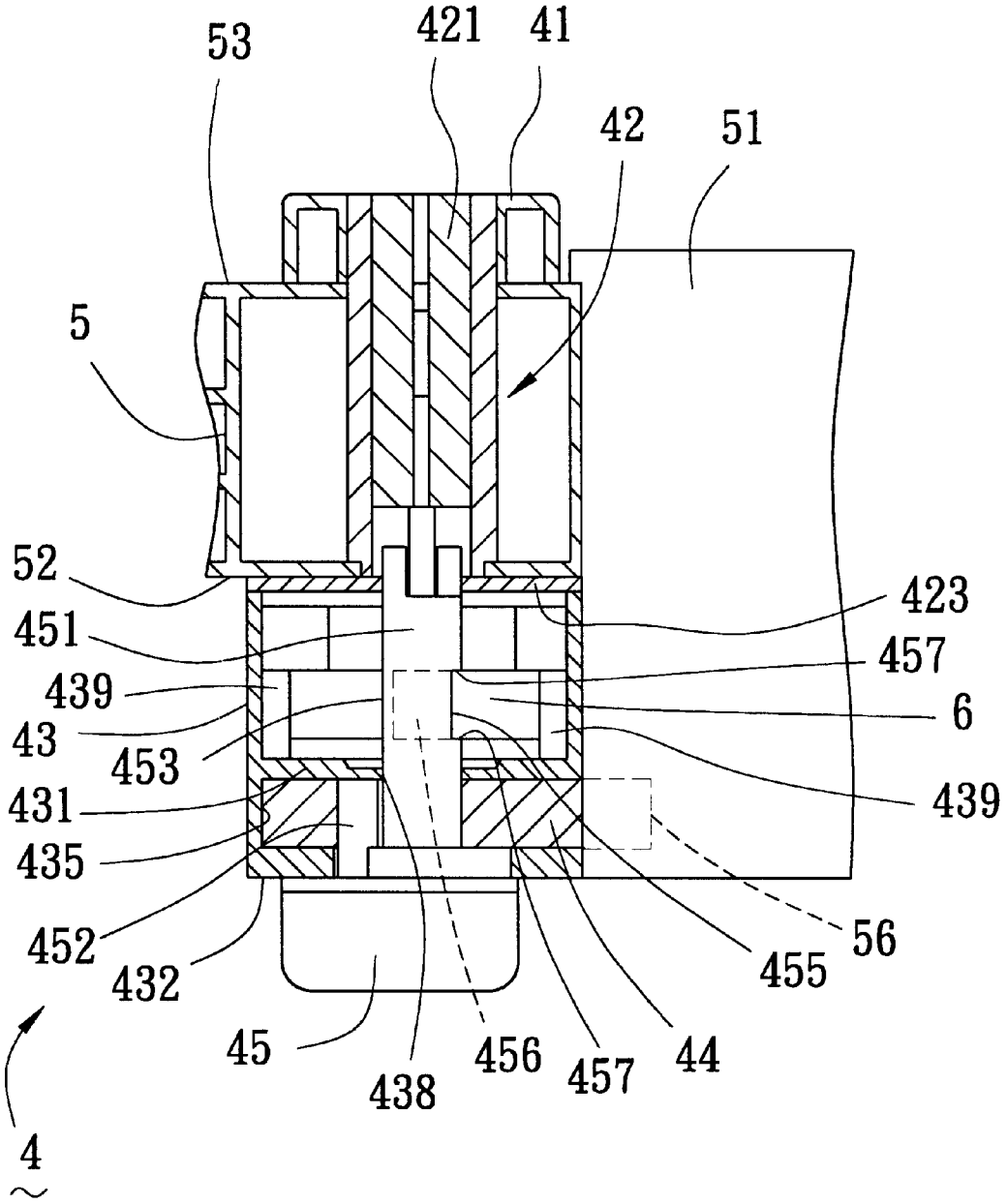
FIG. 4 is a cross-sectional view of the preferred embodiment.

Referring to FIGS. 3 and 4, the preferred embodiment of the lock apparatus 4 of the present invention is adapted to be mounted on a door panel 5 and is operable for locking the door panel 5 to an adjacent door frame 51. The lock apparatus 4 is shown to include an elongated escutcheon 41, a lock core unit 42, a lock housing 43, a latch member 44, and a latch actuator 45.

The door panel 5 is formed with upper and lower fastener holes 55, and a circular cylinder hole 54 between the fastener holes 55.

The escutcheon 41 is adapted to be disposed on an outer side 53 of the door panel 5, and is formed with upper and lower fastening posts 412 to be aligned with the fastener holes 55, respectively, and an access hole 413 to be aligned with the cylinder hole 54 in the door panel 5.

The lock core unit 42 includes a lock cylinder 422 adapted to be extended through the cylinder hole 54, a key-operable lock core body 421 retained in the lock cylinder 422, and a fastening plate 423 connected to one end of the lock cylinder 422. The fastening plate 423 is disposed at an inner side 52 of the door panel 5, and is formed with a central and circular spindle hole 427 aligned with the lock core body 421, and upper and lower fastener holes 426 to be aligned respectively with the fastener holes 55 in the door panel 5. The lock core body 421 has an operable end formed with a key hole 424 which is disposed adjacent to the access hole 413 to permit extension of a key (not shown) thereinto via the access hole 413, and an opposite coupling end 425 disposed adjacent to the spindle hole 427 in the fastening plate 423.

The lock housing 43 is adapted to be disposed at the inner side 52 of the door panel 5 adjacent to the fastening plate 423 of the lock core unit 42, and has a mounting wall 431 parallel to the fastening plate 423, and a looped surrounding wall 433 that extends transversely from a periphery of the mounting wall 431 toward the fastening plate 423 so as to cooperate with the mounting wall 431 to confine a receiving space 434 which has one end closed by the fastening plate 423. A pair screw bolts 70 extend through the mounting wall 431 of the lock housing 43, the fastener holes 426, 55 in the lock core unit 42 and the door panel 5, and into the fastening posts 412 of the escutcheon 41 for fastening the lock housing 43, the lock core unit 42, and the escutcheon 41 to the door panel 5. The mounting wall 431 is formed with a circular spindle hole 438 (see FIG. 4). The lock housing 43 is further formed integrally with a hollow latch mounting portion 432 on one side of the mounting wall 431 opposite to the receiving space 434. The surrounding wall 433 has two opposite lateral wall portions, each of which is formed with a pair of clamping members 439 that define a clamping space 430 therebetween. An elongated spring plate 6 is disposed in the receiving space 434, and spans the lateral wall portions of the surrounding wall 433. The spring plate 6 has two opposite ends 61 which are clamped in the clamping spaces 430, respectively, for retention on the lateral wall portions of the surrounding wall 433, and an intermediate portion 62 disposed adjacent to the spindle hole 438. The latch mounting portion 432 is formed with a latch cavity 435 for receiving the latch member 44, and has a lateral wall portion formed with an opening 436 that is communicated with the latch cavity 435 to permit projection of the latch member 44 therefrom.

The latch actuator 45 includes an operable rotary disc 450 mounted rotatably on the latch mounting portion 432 of the lock housing 43, and a spindle 451 connected to the rotary disc 450 and extending rotatably through the latch cavity 435 and the spindle hole 438 and into the receiving space 434. The spindle 451 has a distal end 459 coupled to the coupling end 425 of the lock core body 421 for co-rotation with the lock core body 421 when the lock core body 421 is operated by the key. The rotary disc 450 is formed with an eccentric actuating rod 452 which extends into the latch cavity 435 and which engages the latch member 44. The latch actuator 45 is operable to rotate about an axis of the spindle 451 in a first direction to a locking position shown in FIG. 6, in which the latch member 44 is moved by the actuating rod 452 to project relative to the lock housing 43 via the opening 436 and is adapted to extend into a latch groove 56 formed in the door frame 51 so as to lock the door panel 5 to the door frame 51. The latch actuator 45 is further operable to rotate about the axis of the spindle 451 in an opposite second direction to an unlocking position shown in FIG. 5, in which the latch member 44 is retracted into the latch cavity 435 to unlock the door panel 5 from the door frame 51.

Referring again to FIGS. 3 and 4, the spindle 451 has a circumferential surface with a circular cross-section, and a positioning section 453 with a non-circular cross-section. The positioning section 453 is disposed in the receiving space 434, and has a peripheral portion formed with a flat first positioning surface 455 and a flat second positioning surface 456 that is angularly displaced from the first positioning surface 455. Each of the first and second positioning surfaces 455, 456 extends along a chord direction of the circular cross-section of the spindle 451, and is indented radially relative to the circumferential surface so as to define a pair of radially extending retaining shoulders 457 at opposite axial edges of a respective one of the first and second positioning surfaces 455, 456. In the present embodiment, the first positioning surface 455 is adjacent and perpendicular to the second positioning surface 456. The spring plate 6 extends in a direction perpendicular to the spindle 451, and is aligned with the positioning section 453 of the spindle 451. The intermediate portion 62 of the spring plate 6 has one side confronting and abutting resiliently against the positioning section 453 of the spindle 451.

Figure 6:
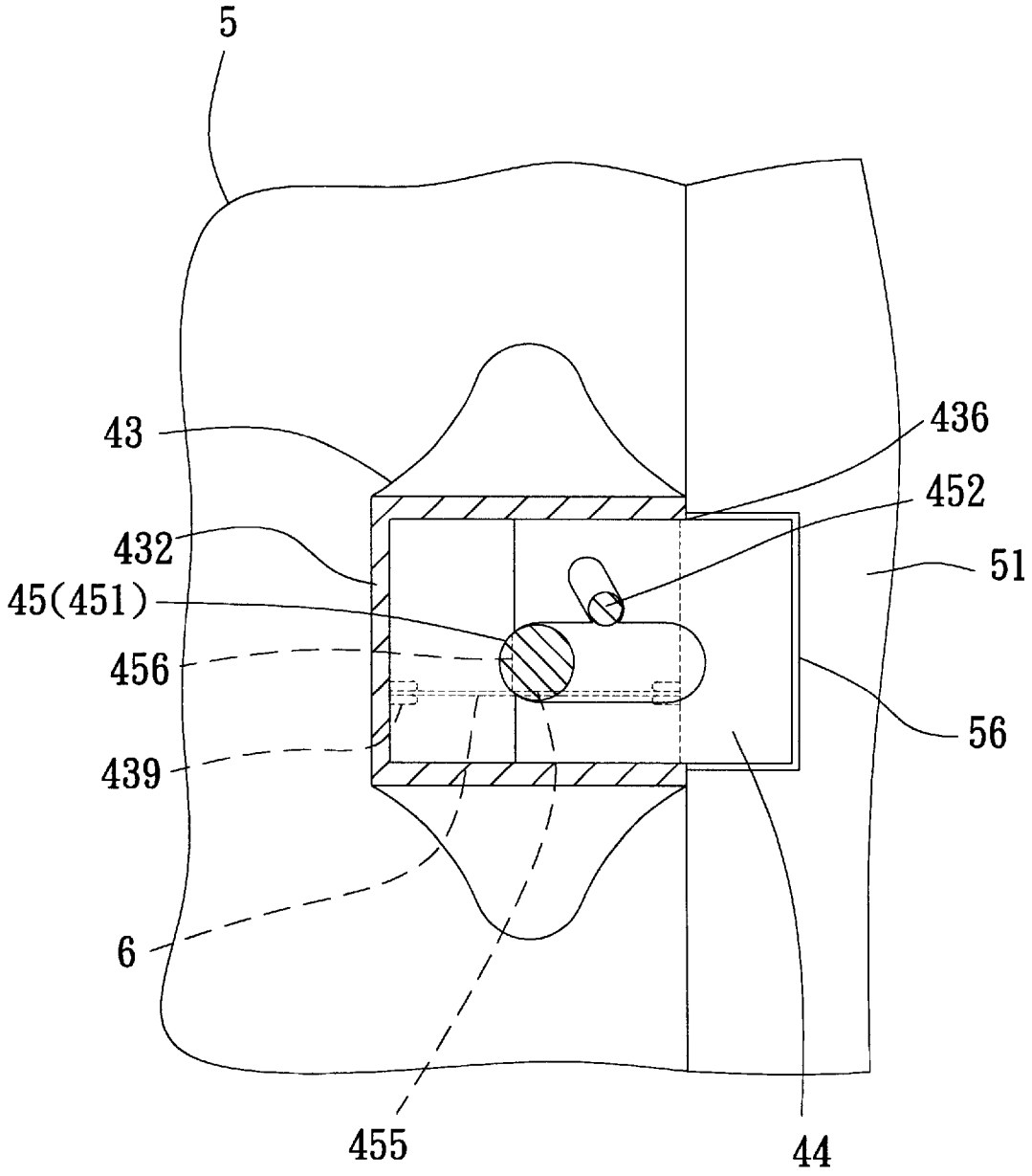
FIG. 6 is yet another cross-sectional view of the preferred embodiment, wherein the latch actuator is in a locking position.

Referring to FIG. 6, the spring plate 6 abuts resiliently against the first positioning surface 455 of the spindle 451 to retain the latch actuator 45 in the locking position. At this time, the spring plate 6 is disposed between the retaining shoulders 457 (see FIG. 4) at the opposite axial edges of the first positioning surface 455 to prevent axial movement of the spindle 451 and avoid removal of the same from the lock housing 43.

Figure 5:
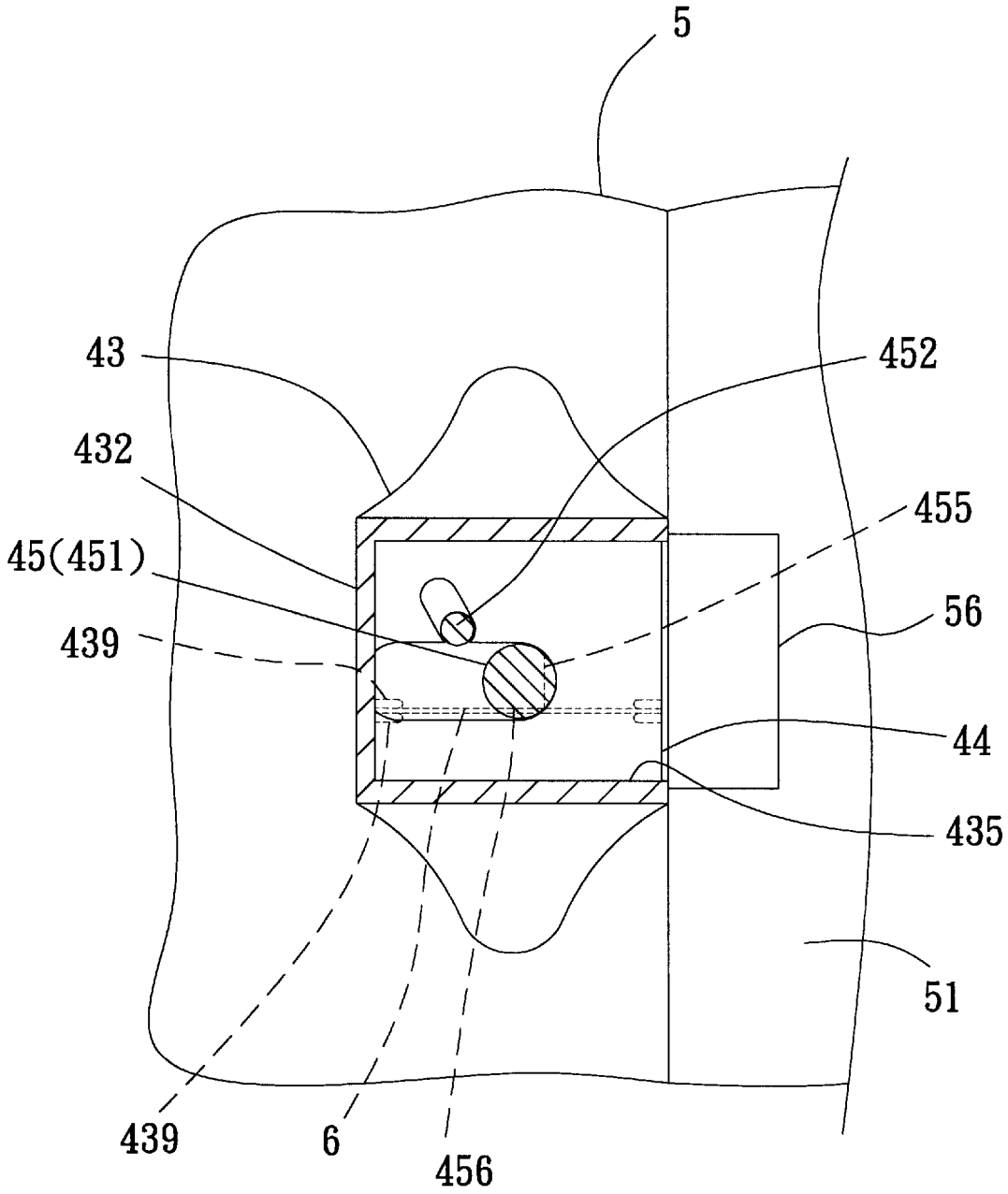
FIG. 5 is another cross-sectional view of the preferred embodiment, wherein a latch actuator is in an unlocking position.

Referring to FIG. 5, the spring plate 6 abuts resiliently against the second positioning surface 456 of the spindle 451 to retain the latch actuator 45 in the unlocking position. Similarly, at this time, the spring plate 6 is disposed between the retaining shoulders 457 (see FIG. 4) at the opposite axial edges of the second positioning surface 456 to prevent axial movement of the spindle 451 and avoid removal of the same from the lock housing 43.

Figure 1:
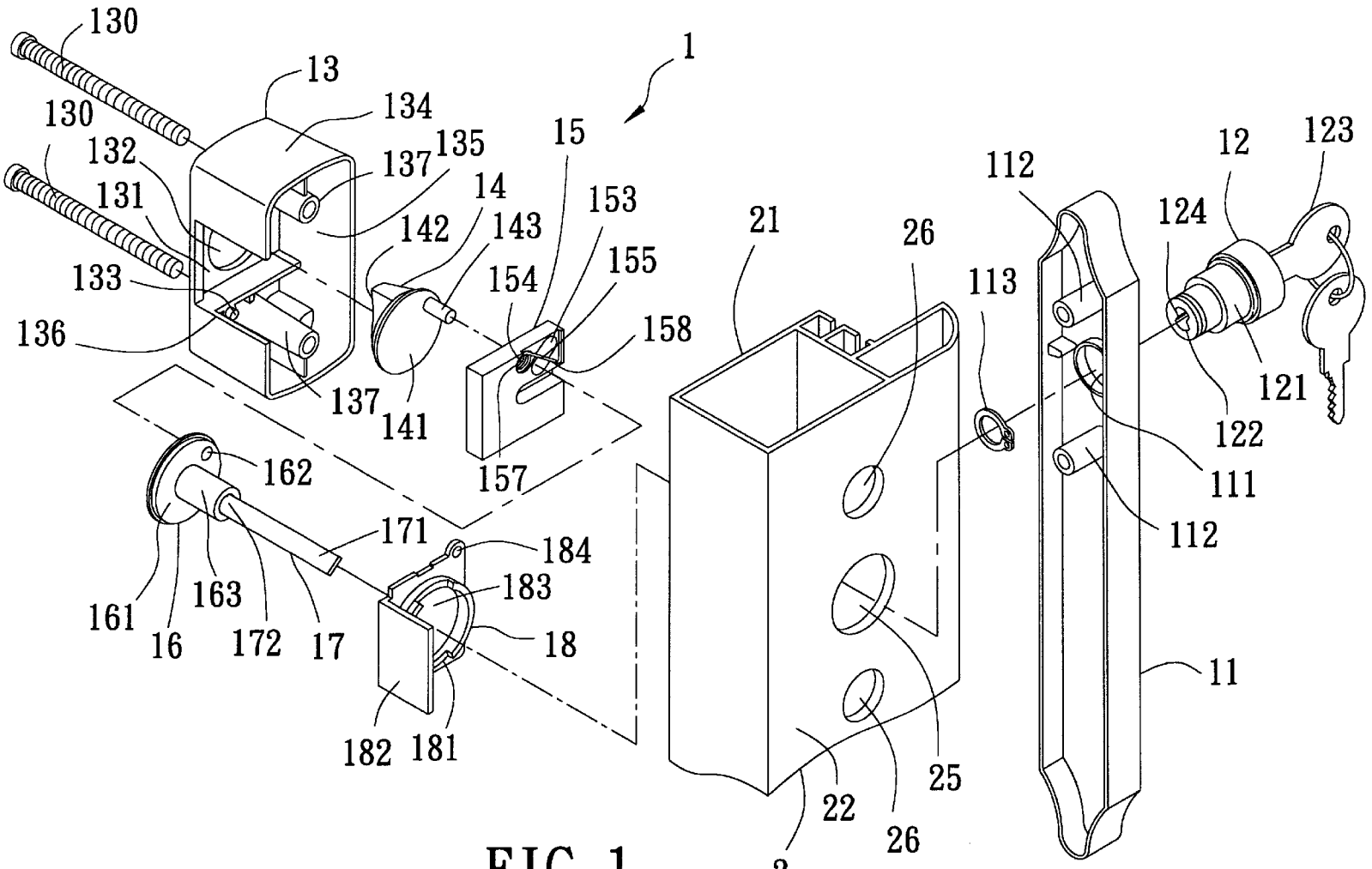
FIG. 1 PRIOR ART
FIG. 1 is an exploded perspective view of a conventional lock apparatus.
Figure 2:
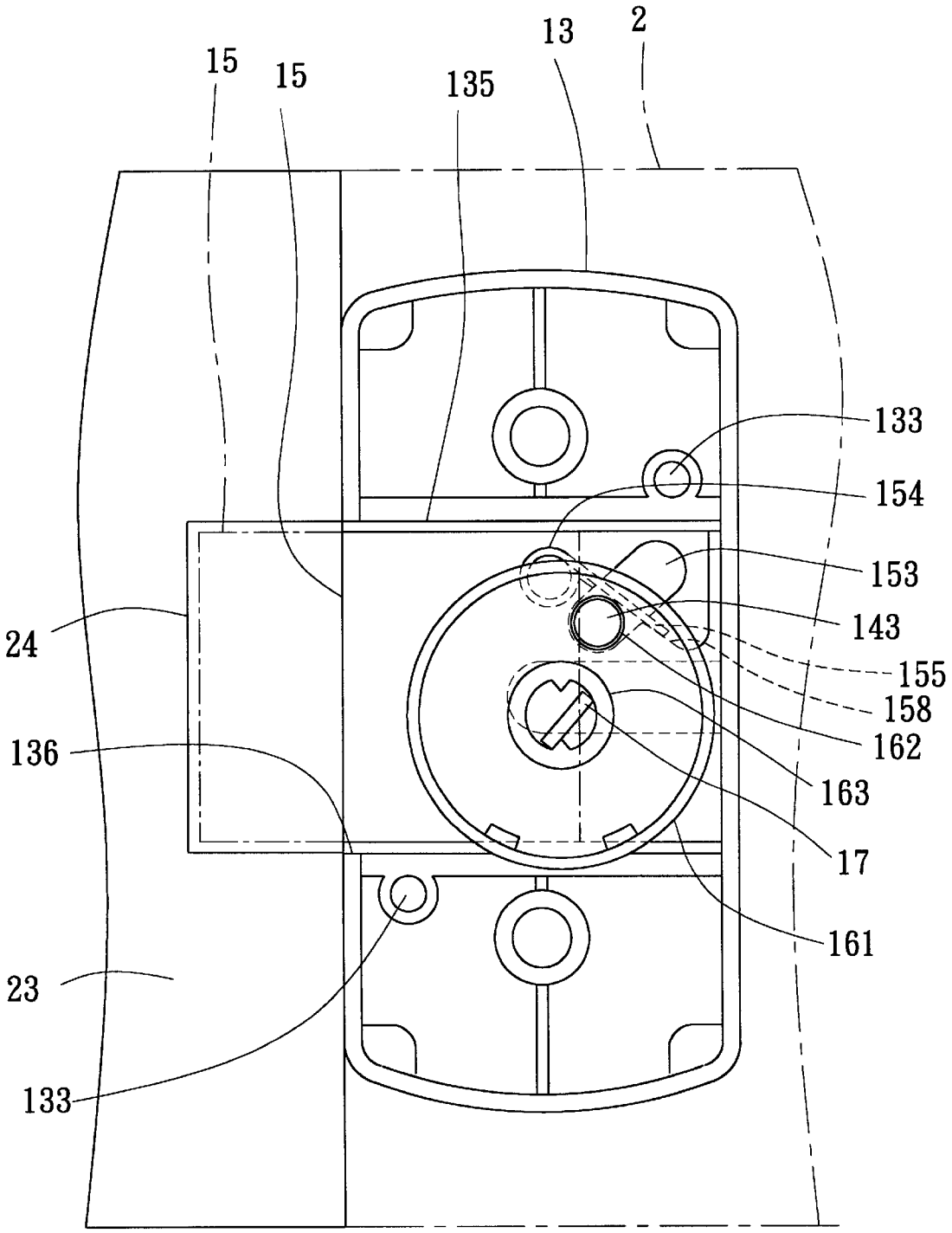
FIG. 2 PRIOR ART
FIG. 2 is a schematic view illustrating the conventional lock apparatus.

Therefore, with the provision of the resilient spring plate 6 in the lock housing 43 and the positioning section 453 on the spindle 451 of the latch actuator 45, the latch actuator 45 can be retained in the locking and unlocking positions, and can be prevented from removal from the lock housing 43. The lock apparatus of the present invention has a more simple structure when compared with the conventional lock apparatus of FIG. 1. The manufacture and assembly processes can be simplified accordingly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lock apparatus comprising:

a lock housing having a mounting wall and a surrounding wall that extends transversely from said mounting wall and that cooperates with said mounting wall to confine a receiving space, said mounting wall being formed with a circular spindle hole communicated with said receiving space;

a latch actuator mounted on said lock housing, said latch actuator including an operable rotary disc and a spindle which is connected to said rotary disc and which extends rotatably into said receiving space of said lock housing via said spindle hole, said rotary disc being operable to rotate said latch actuator about an axis of said spindle between a locking position and an unlocking position, said spindle having a positioning section which has a non-circular cross-section and which is disposed in said receiving space, said positioning section having a peripheral portion formed with a flat first positioning surface and a flat second positioning surface that is angularly displaced from said first positioning surface;

a latch member mounted movably on said lock housing and associated operably with said latch actuator such that said latch member projects relative to said lock housing when said latch actuator is moved to the locking position and such that said latch member is retracted into said lock housing when said latch actuator is moved to the unlocking position; and an elongated spring plate mounted in said receiving space of said lock housing and extending in a direction perpendicular to said spindle of said latch actuator, said spring plate abutting against said first positioning surface to retain said latch actuator in the locking position, and abutting against said second positioning surface to retain said latch actuator in the unlocking position.

2. The lock apparatus according to claim 1, wherein said first and second positioning surfaces are adjacent and perpendicular to each other.

3. The lock apparatus according to claim 1, wherein said spindle has a circumferential surface with a circular cross-section, each of said first and second positioning surfaces extending along a chord direction of the circular cross-section of said spindle.

4. The lock apparatus according to claim 3, wherein each of said first and second positioning surfaces has opposite axial edges and is indented radially relative to said circumferential surface so as to define a pair of radially extending retaining shoulders at said opposite axial edges of a respective one of said first and second positioning surfaces, said spring plate being disposed between said retaining shoulders when said latch actuator is in either one of the locking and unlocking positions so as to prevent movement of said latch actuator along the axis of said spindle.

5. The lock apparatus according to claim 1, wherein said surrounding wall of said lock housing has opposite lateral wall portions, said spring plate spanning said lateral wall portions and having two opposite ends retained respectively on said lateral wall portions, and an intermediate portion which has one side confronting said positioning section of said spindle.

6. The lock apparatus according to claim 5, wherein each of said lateral wall portions of said surrounding wall of said lock housing is formed with a pair of clamping members for clamping a respective one of said ends of said spring plate therebetween.

7. The lock apparatus according to claim 1, wherein said lock housing is formed integrally with a hollow latch mounting portion which has a latch cavity to permit retraction of said latch member thereinto when said latch actuator is moved to the unlocking position, said latch mounting portion being formed with an opening communicated with said latch cavity to permit projection of said latch member from said latch cavity when said latch actuator is moved to the locking position.

* * * * *